United States Patent [19]

Schuller et al.

[11] Patent Number: 4,687,148

[45] Date of Patent: Aug. 18, 1987

[54] APPARATUS AND PROCESS FOR FORMING A THREAD-RESERVE WINDING

[75] Inventors: Edmund Schuller, Ingolstadt; Günther Böhm, Kipfenberg; Rupert Karl, Ingolstadt, all of Fed. Rep. of Germany

[73] Assignee: Schubert & Salzer, Ingolstadt, Fed. Rep. of Germany

[21] Appl. No.: 869,816

[22] Filed: Apr. 30, 1986

Related U.S. Application Data

[63] Continuation of Ser. No. 679,264, Dec. 7, 1984, abandoned.

[30] Foreign Application Priority Data

Dec. 9, 1983 [DE] Fed. Rep. of Germany ..... 3344645

[51] Int. Cl.[4] ..... B65H 54/02; B65H 54/34; B65H 65/00

[52] U.S. Cl. ..... 242/18 PW; 242/18 DD; 242/129.51

[58] Field of Search ..... 242/18 PW, 18 DD, 18 A, 242/25 A, 35.5 A, 35.5 R, 35.6 R, 129.51

[56] References Cited

U.S. PATENT DOCUMENTS

| | | | |
|---|---|---|---|
| 2,262,145 | 11/1941 | Kimpton | 242/18 PW X |
| 3,488,010 | 1/1970 | Parry | 242/18 PW |
| 3,921,921 | 11/1975 | Katayama et al. | 242/18 PW X |
| 4,093,135 | 6/1978 | Hermanns | 242/18 PW |
| 4,143,825 | 3/1979 | Lovas et al. | 242/18 PW |
| 4,154,409 | 5/1979 | Reisser et al. | 242/18 PW |
| 4,158,444 | 6/1979 | Kraus | 242/18 PW |
| 4,164,330 | 8/1979 | Maassen et al. | 242/18 PW |
| 4,324,368 | 4/1982 | Inouye et al. | 242/18 PW |
| 4,451,007 | 5/1984 | Ohkubo et al. | 242/18 PW X |
| 4,501,116 | 2/1985 | Schuller et al. | 57/263 |

*Primary Examiner*—Stanley N. Gilreath
*Attorney, Agent, or Firm*—Dority & Manning

[57] ABSTRACT

In an apparatus for forming a thread-reserve winding, with a bobbin plate (4) which rotates together with the bobbin tube (3) and which engages by means of a centering shoulder into the inside diameter of the bobbin tube and has a thread-catching device, there are arranged on the periphery of the bobbin plate (4) slits (40) which extend in a radial direction up to the inner centering shoulder. The slits (40) can be made straight or arcuate and, to guarantee that the thread is caught particularly securely, form their entrance at an acute angle with the tangent to the periphery of the bobbin plate (4). To bring the thread into a position favorable for catching it, two thread guide elements (7, 8) can be moved into the thread path extending from a thread draw-off pipe (1) to a thread-suction device (6). These feed the thread to the thread-catching device approximately parallel to the tube axis.

11 Claims, 4 Drawing Figures

APPARATUS AND PROCESS FOR FORMING A THREAD-RESERVE WINDING

This is a continuation of application Ser. No. 679,264, filed Dec. 7, 1984, now abandoned.

BACKGROUND OF THE INVENTION

The invention relates to an apparatus for forming a thread-reserve winding on a bobbin tube with a bobbin plate which rotates together with the bobbin tube. The bobbin plate engages a centering shoulder in the inside diameter of the bobbin tube and has a thread-catching device. The invention further relates to the process for forming a thread-reserve winding as disclosed and described herein.

In a known apparatus of the type mentioned above (European Preliminary Publication No. 69,205, now the same as corresponding U.S. Pat. No. 4,501,116), the bobbin tube is received between two bobbin plates mounted rotatively in the bobbin arms. For centering the bobbin tube, the bobbin plates conventionally have at least one inner shoulder engaging into the inside diameter of the bobbin tube. Also, one of the bobbin plates rotating together with the bobbin tube is provided with a thread-catching device in order, after the bobbin has been changed, to transfer the thread to the inserted empty tube, where some reserve turns are first formed before the actual winding of the bobbin takes place.

Since the bobbin change should take place without an interruption in the spinning operation of the open-end spinning machine, there is also a thread-suction device which receives the continuously supplied thread after an interruption in the spooling operation when the full bobbin is ejected, until the empty tube has been inserted and the thread can be transferred to this. To transfer the thread to the spooling device, the thread-suction device receiving the spun thread has assigned to it a thread guide, the function of which is, on the one hand, to bring the thread together with the suction device into the region of the thread-catching device and, on the other hand, after the reserve winding has been formed, to transfer the thread to the transversing thread guide in order to wind onto the bobbin. After being secured in the thread-catching device, the thread is cut off by a thread-severing device preferably assigned to the thread-suction device.

However, in this method of thread feeding, it has been shown that the method of feeding the thread for the thread-catching device results in relatively long thread ends which are thrown around during the winding of the bobbin and, consequently, not only do they become frayed and useless for subsequent piecing to the preceding bobbin during further processing, but also the reserve winding is loosened, so that it falls off from the tube and is, therefore, wasted.

SUMMARY OF THE INVENTION

The object of the present invention is to provide an apparatus which makes it possible to catch and secure a thread end reliably during the production of a thread reserve.

In an apparatus constructed in accordance with the present invention, there are arranged on the periphery of the bobbin plate slits which extend in a radial direction to the inner centering shoulder which make it possible to secure a thread end reliably during the production of a thread reserve.

As a result, the thread end remaining in the thread-catching device is transported into the interior of the bobbin tube and consequently secured under protection. It has been shown, in particular, that in spite of the clamping, a relative movement arises between the bobbin tube and bobbin plate during the winding operation, in such a way that the bobbin plate requires a rotation which is slightly in advance of that of the bobbin tube. As a result of this movement, the thread caught in the slit of the thread-catching device is taken up and drawn more and more deeply into the slit, until at the bottom of the slit, it passes into the interior of the bobbin tube. Thread ends hanging out, which are thrown around and consequently destroyed, are avoided in this way. Moreover, no tensile force loosening the reserve turn is exerted on the thread end. The slits can be made straight or even arcuate in order to convey the thread end into the interior of the bobbin tube. To guarantee that the thread is caught securely and effectively, the slits form at their outer end an acute angle with the tangent to the periphery of the bobbin plate.

According to a further feature of the invention, two thread guide elements can be moved into the thread path extending from a thread draw-off pipe to a thread-suction device and feed the thread to the thread-catching device approximately parallel to the tube axis. This ensures a position favorable for catching the thread and a short thread end which can be fixed securely.

During the thread feed, the first thread guide element at the same time brings the thread portion extending into the thread-suction device into the region of a thread-severing device so that, without additional means, severing is also carried out and consequently short thread ends are obtained directly during feeding. For the winding on of the reserve turn, the second thread guide element, continuing its feed movement, moves the thread away from the bobbin plate in the direction of the tube center and back again towards the bobbin plate. This ensures that reserve turns are wound over the thread end which is consequently secured.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention is not restricted to open-end spinning machines, but can also be used advantageously on spinning machines from which the thread is drawn off by a pair of draw-off rollers, irrespective of the method of thread feeding and reserve formation.

The invention is described below in conjunction with an open-end spinning machine as a thread supply station. However, the description is restricted to the delivery of the thread in front of the spooling station and the formation of the thread-reserve winding. The process steps preceding these measures, such as the joining of the thread sent back from the bobbin, removal of the leader and the exchange of the bobbin for an empty tube, are described, for example, in U.S. Pat. No. 4,501,116, so that there is no need to discuss these again here.

Figure 1:
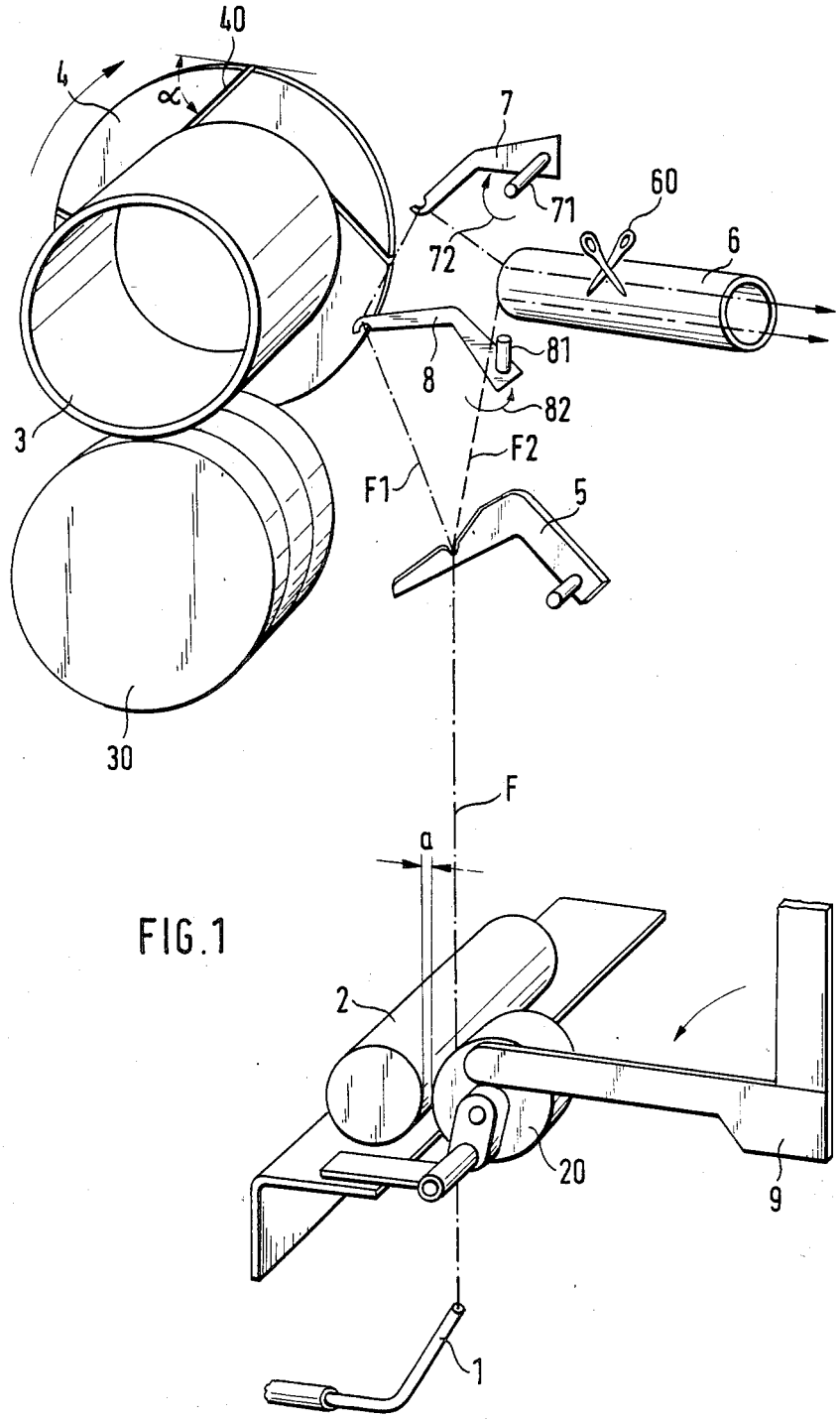
FIG. 1 shows, in a perspective representation, an apparatus constructed in accordance wtih the invention for forming a thread-reserve winding.

In FIG. 1, reference numeral 1 denotes the thread draw-off pipe of an open-end spinning machine through which the spun thread F is drawn off continuously. The thread draw-off is carried out by a pair of draw-off rollers 2, 20.

Figure 3:
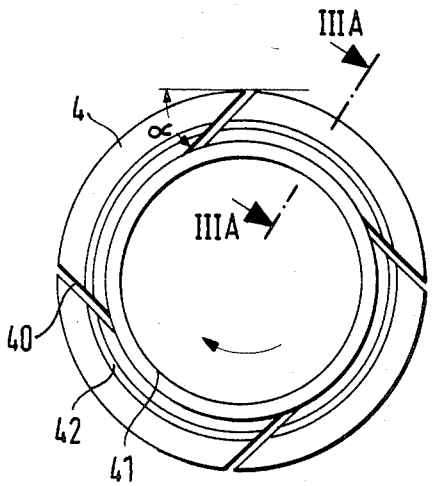
FIG. 3 shows a bobbin plate with slits extending up to its centering shoulder.

Of the spooling apparatus, only a bobbin tube 3 with a bobbin plate 4 and its drive roller 30 are shown. However, the bobbin tube 3 is held in a known way by two bobbin arms which press it against the drive roller 30. A bobbin plate 4 is mounted rotatively in each of the two bobbin arms, and of these, the bobbin plate 4 illustrated has several slits 40 serving as a thread-catching device. These slits 40 extend from the outer periphery of the bobbin plate in a radial direction up to a centering shoulder 41 which engages into the interior of the bobbin tube and consequently centers it and retains it in a radial direction. In FIG. 3, these slits are shown straight and at their entrance from an acute angle $\alpha$ with the tangent to the periphery of the bobbin plate 4. However, they can also be made arcuate so that they open into the inner centering shoulder 41 in an approximately radial direction.

Figure 2:
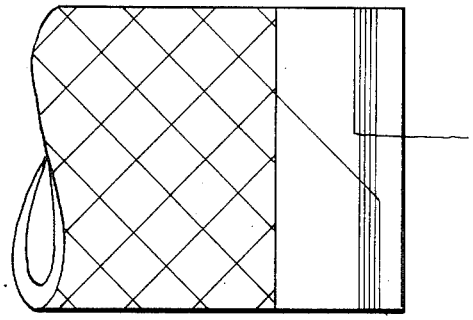
FIG. 2 shows, as seen from the front, a portion of a bobbin tube with a thread-reserve winding produced by means of the apparatus according to FIG. 1.

The handling and guidance of the thread F before and during its transfer to the bobbin tube 3 correspond to the operations as described in U.S. Pat. No. 4,501,116. The thread guide 5 shown in FIG. 2 of U.S. Pat. No. 4,501,116 corresponds to the thread guide fork 5 in FIG. 1, which is arranged in front of the bobbin tube 3. The only difference is that the thread guide fork 5 is not displaceable. Furthermore, the pipe-shaped thread-suction device 6, connected to a vacuum source (not shown) and having a thread-severing device 60 in the vicinity of its mouth, corresponds to the mouth 40 of the thread-suction device 4 in U.S. Pat. No. 4,501,116. This severing device can be arranged inside the pipe or, as shown in U.S. Pat. No. 4,501,116, also outside the pipe. The thread guide fork 5 is arranged rotatably on a pivot 81 fixed in place.

Near the outside of the bobbin plate 4, there is a first thread guide element 7, while a second thread guide element 8 is arranged on the side of the bobbin plate 4 facing the bobbin tube. The two thread guide elements 7 and 8 are fastened pivotably the thread-suction device 6 as illustrated in FIG. 1 so that they can grasp the outfrom thread extending from the thread draw-off pipe 1 of the spinning machine and pivot to pass same up to the thread-suction device 6, as illustrated clearly by the respective arrows of rotation 72 and 82 and the separate dot-dash line F1 and broken line F2 representations of the two different positions of thread F resulting from the selective pivoting of guide elements 7 and 8. Actual means for achieving such pivoting, such as solenoid drives, are well understood by one of ordinary skill in the art, and disclosed generally in U.S. Pat. No. 4,501,116 discussed above. Hence description of such drives is not repeated here or in the Figs. for the sake of simplicity.

The pipe shaped thread-suction device 6 is pivotable from a thread take-up position associated with thread line F2 into the position associated with thread line F1 according to FIG. 1, in which its mouth is arranged laterally relative to the outside of the bobbin plate 4, but still in front of this in relation to the thread running direction. A thread-severing device 60 is arranged fixed in place in the thread-suction device 6, appropriately in the vicinity of its mouth, to keep the length of the cut off thread end within limits. Because the two thread guide elements 7 and 8 are fastened to the thread-suction device 6, they can be moved, together with the thread-suction device, out of an initial position into the vicinity of the bobbin plate and back again.

The thread guide elements 7 and 8 are arranged, together with the thread-suction device 6 and the thread guide fork 5 on a movable servicing trolley (not shown) and are, accordingly, brought into position in front of the winding-on device of each spinning station in order to exchange a complete bobbin for an empty tube and transfer to this empty tube the thread coming from the spinning machine.

After the complete bobbin has been removed and an empty tube 3 inserted for winding, the thread F drawn continuously from the thread draw-off pipe 1 by the draw-off rollers 2, 20 runs first into the thread-suction device 6, being guided on its way there, indicated by a broken line, in the thread guide fork 5. At this moment, the thread guide fork 5 is located in the radial plane of the end face of the bobbin plate 4. Subsequently, the first thread guide element 7 and the second thread guide element 8 are moved into the thread path, so that the thread is grasped and, held by these two thread guide elements and fed to the thread-catching device 40 of the bobbin plate 4 in such a way that this thread portion is aligned approximately parallel to the tube axis. The more parallel the feed, the more accurately the thread can be caught and guided into one of the slits 40 and, moreover, the shortest thread ends are obtained as a result. At the moment when the thread is fed and grasped by the thread-catching device 40, the thread portion extending into the thread-suction device 6 must be severed. For this purpose, as a result of the movement of the first thread guide element 7, not only is the thread fed, but at the same time the thread portion extending into the thread-suction device 6 is brought into the region of a thread-severing device 60 which is located as near as possible to the suction orifice of the thread suction device 6. The thread-severing device 60 can be arranged on the thread-suction device 6, according to the U.S. Pat. No. 4,501,116, or even in the thread-suction device 6, as shown diagrammatically in FIG. 1.

Figure 3A:
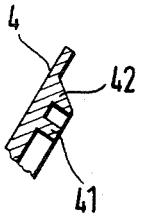
FIG. 3*a* shows a section through the bobbin plate along the line 3*a*—3*a*in FIG. 3.

As already mentioned above, in the same time as the first thread guide element 7, the second thread guide element 8 is also moved into the thread path, so that the thread portion located between the first thread guide element 7 and the second thread guide element 8 is in a position in which it intersects the plane of rotation of the thread-catching slits 40 on the periphery of the bobbin plate 4 rotating together with the bobbin tube 3 and is thereby caught by one of these slits and taken up by the bobbin plate. For winding on the reserve turn, the second thread guide element 8, continuing its feed movement, is now moved away from the bobbin plate 4 in the direction of the tube center and back again to the bobbin plate. This produces a reserve winding which is wound over again as a result of the reverse movement of the thread guide element 8, so that the thread end extending outwards to the bobbin plate is secured as a result of this overwinding. Because of its reverse movement back into its initial position, the second thread guide element 8 finally moves out of the thread run and thus again releases the thread which is now guided only by the thread guide fork 5 in the radial plane of the end face of the bobbin plate 4. A deflecting shoulder 42 (FIG. 3*a*) on the bobbin plate 4, located on the side of the bobbin plate 4 facing the bobbin tube 3, ensures that the position of the thread-reserve winding on the bobbin tube is maintained exactly. The operation of forming the thread-reserve winding and securing it is now ended, and the thread guide fork 5 transfers the thread to the traversing thread guide for winding onto the bobbin, as described by way of example in U.S. Pat. No. 4,501,116.

In spite of the clamping of the bobbin tube between the bobbin plates, a relative movement between the bobbin plate and the bobbin tube arises during the winding of the bobbin, the bobbin plate being slightly in advance of the tube. As a result, the free thread end hanging in one of the slits 40 is drawn out of this slit, thrown around and framed or even brought under the bobbin winding so that it is wasted when it comes to piecing the next bobbin during further processing. It has been shown, surprisingly, that when the slits are designed according to the invention, this is avoided in a simple way. In the slits which now extend up to the inner centering shoulder 41, the thread slips past the end face of the bobbin tube into the interior and remains protected there during the entire spooling operation. When the bobbin is taken out of the bobbin-plate mounting, an undamaged thread end is thus obained, and by means of this, the reserve turn can be drawn off and is, therefore, available intact for piecing the next bobbin during further processing.

The thread reserve is preferably wound on under the tension from spinning associated with thread F emerging from an open-end spinning machine via pipe 1, because thread F is, for example, ejected from the nip line of the pair of draw-off rollers or, as shown in FIG. 1, the pressure roller 2 of the pair of draw-off rollers is lifted a distance a from its drive roller. Such spinning tension ensures that the thread reserve is wound onto the tube sufficiently taughtly.

What is claimed is:

1. A process for forming a thread-reserve winding on a bobbin tube having an inside diameter defining an interior thereof and an associated bobbin plate with an integral centering shoulder which extends into said inside diameter, said process comprising the steps of:

providing a thread draw-off pipe and thread suction device with said suction device in the vicinity of said bobbin plate, said pipe and said suction device defining a thread path therebetween;

providing a thread-catching device associated with said bobbin plate, said thread-catching device including at least one slit formed between the periphery of said bobbin plate and said centering shoulder thereof;

providing a thread severing device within said thread suction device;

providing controllably movable first and second thread guide elements adjacent said thread path;

providing thread in said thread path and extending into said thread suction device;

controllably rotating the bobbin tube about its axis;

simultaneously moving said first and second thread guide elements into said thread path so as to engage said thread to form a thread portion located between said thread guide elements;

presenting said thread portion to said thread catching device in a disposition approximately parallel to the rotation axis of said bobbin tube;

catching said thread portion by means of said slit and simultaneously severing with said thread severing device said thread extending into said thread suction device so as to form a free thread end hanging out from said slit;

forming a thread-reserve winding by guiding said thread by moving said second thread guide element away from said bobbin plate and in a direction towards the bobbin tube center, while rotating said bobbin tube and plate;

moving said second guide element back towards said bobbin plate while continuing said rotation of said bobbin tube and plate so as to wind thread over said thread-reserve winding; and drawing said thread caught in said slit to the bottom of said slit adjacent said centering shoulder and conveying said free thread end into said interior of said bobbin tube during winding of thread on said bobbin tube, whereby said thread end is reliably secured and protected within said bobbin tube.

2. A process as in claim 1, wherein said at least one slit generally defines a straight line.

3. A process as in claim 1, wherein said at least one slit generally defines an arcuate line.

4. A process as in claim 1, wherein said at least one slit defines an acute angle with a line tangential to said periphery of said bobbin plate.

5. A process for forming a thread-reserve winding on a bobbin tube having an inside diameter defiing an interior thereof and an associated bobbin plate with an integral centering shoulder which extends into said inside diameter, said process comprising the steps of:

providing a thread draw-off pipe and thread suction device with said suction device in the vicinity of said bobbin plate, said pipe and said suction device defining a thread path therebetween;

providing a thread-catching device associated wtih said bobbin plate, said thread-catching device including at least one slit formed between the periphery of said bobbin plate and said centering shoulder thereof;

providing a thread severing device within said thread suction device;

providing a thread guide fork positioned in said thread path and in the radial plane of said bobbin plate periphery;

providing controllably movable first and second thread guide elements adjacent said thread path;

providing thread in said thread path, guided by said thread guide fork, and extending into said thread suction device;

controllably rotating the bobbin tube about its axis;

simultaneously moving said first and second thread guide elements into said thread path so as to engage said thread to form a thread portion located between said thread guide elements;

presenting said thread portion to said thread catching device in a disposition approximately parallel to the rotation axis of said bobbin tube;

catching said thread portion by means of said slit and simultaneously severing with said thread severing device said thread extending into said thread suction device so as to form a free thread end hanging out from said slit;

forming a thread-reserve winding by guiding said thread by moving said second thread guide element away from said bobbin plate and in a direction towards the bobbin tube center, while rotating said bobbin tube and plate;

moving said second guide element back towards said bobbin plate while continuing said rotation of said bobbin tube and plate so as to wind thread over said thread-reserve winding; and drawing said thread caught in said slit to the bottom of said slit adjacent said centering shoulder and conveying said free thread end into said interior of said bobbin tube during winding of thread on said bobbin tube, whereby said thread end is reliably secured and protected within said bobbin tube.

6. An apparatus for forming a thread-reserve winding on a bobbin tube and reliably securing an end of such thread reserve, comprising:

a bobbin tube having at least one end, and respective outside and inside diameters;

a substantially circular bobbin plate having a radius greater than that of said bobbin tube outside diameter;

means for generally engaging said bobbin plate with said bobbin tube end so as to permit slight relative rotation therebetween;

means for rotating said bobbin plate and tube, with a resulting slight relative rotational movement therebetween, and with said plate leading said tube; and means, operative during rotation of said bobbin tube and plate, for receiving and drawing a thread end in between said bobbin plate and tube, and for further conveying said end, during relative rotation of said plate and bobbin, into an area within said tube inside diameter, where said end is reliably secured and protected for subsequent piecing to another thread end.

7. An apparatus as in claim 6, wherein said means for engaging include concentric annular deflecting shoulder and centering shoulder members disposed on said bobbin plate for capturing said bobbin tube end, with said centering and deflecting shoulders located within said tube inside diameter and outside said tube outside diameter, respectively.

8. An apparatus as in claim 7, wherein said means for receiving, drawing, and conveying includes at least one slit formed in said bobbin plate, which slit extends generally between the periphery of said plate and said centering shoulder disposed thereon within the interior of said tube, through which slit a thread is conveyed from the exterior of said bobbin tube into the protection of said interior thereof during rotation of said bobbin plate slightly in advance of said bobbin tube.

9. An apparatus as in claim 8 wherein said slit defines generally a straight line.

10. An apparatus as in claim 8 wherein said slit defines generally an arcuate line.

11. An apparatus as in claim 8 wherein said slit defines at its opening adjacent said plate periphery an acute angle with a tangent to said bobbin plate at the point of said opening.

* * * * *